United States Patent [19]

Socha

[11] 4,400,854

[45] Aug. 30, 1983

[54] METHOD AND DEVICE FOR DEPOSITING SLIVER IN A ROTATING CAN

[75] Inventor: Johannes Socha, Mönchen-Gladbach, Fed. Rep. of Germany

[73] Assignee: W. Schlafhorst & Co., Mönchen-Gladbach, Fed. Rep. of Germany

[21] Appl. No.: 4,075

[22] Filed: Jan. 17, 1979

[30] Foreign Application Priority Data

Jan. 19, 1978 [DE] Fed. Rep. of Germany ..... 2802216

[51] Int. Cl.[3] ..... B65H 54/80

[52] U.S. Cl. ..... 19/159 R; 242/82

[58] Field of Search ..... 19/159 R; 242/82

[56] References Cited

U.S. PATENT DOCUMENTS

| | | | |
|---|---|---|---|
| 3,324,515 | 6/1967 | West | 19/159 R |
| 3,638,278 | 2/1972 | Johnels | 19/159 R |
| 4,153,212 | 5/1979 | Bauch et al. | 19/159 R |
| 4,223,422 | 9/1980 | Weber | 19/159 R |
| 4,236,278 | 12/1980 | Hoover | 19/159 R |
| 4,236,279 | 12/1980 | kawaura | 19/159 R |

*Primary Examiner*—Louis Rimrodt

*Attorney, Agent, or Firm*—Herbert L. Lerner

[57] ABSTRACT

Method for depositing sliver formed of textile fibers in cycloidal loops in a rotating can, which includes feeding the sliver through a rotating funnel wheel having a guide canal formed therein with an opening extending toward the can, and rotating the funnel wheel with periodically changing angular velocity to reduce variation in silver deposit velocity and device for implementing the method.

11 Claims, 3 Drawing Figures

METHOD AND DEVICE FOR DEPOSITING SLIVER IN A ROTATING CAN

The invention relates to a method and device for depositing sliver formed of textile fibers in cycloidal loops in a can rotating on a can turntable, by means of a rotating funnel wheel which has formed therein a sliver guide canal with a canal opening pointing toward the can.

The funnel wheel is also referred to as a rotating disc or coiler. Such devices are used in drawing or stretching for making sliver or for reloading sliver from large into small cans. Up to now, the funnel wheel and the can turntable each used to rotate with constant angular velocity. The funnel wheel rotates about 40-times faster than the can table.

The sliver is deposited against the force of a soft can spring which pushes against a movable spring bottom or platform from below. The sliver leaving the canal opening therefore does not fall into empty space but comes to rest at the spring bottom or at the uppermost layer of sliver which is already deposited on the spring bottom. Since the funnel wheel rotates eccentrically to the can turntable, periodic variations of the sliver deposition velocity result. If the direction of rotation of the funnel wheel and the can turntable is the same, the sliver deposition velocity is higher than the mean velocity if the canal opening is located near the central axis of the can, and conversely, lower than its mean value if the canal opening is near the rim of the can. In the first case, a slight straining of the sliver takes place and in the second case, a slight compression. In the further processing of the sliver in a ring spinning frame, long-wave density variations in the finished yarn result therefrom.

It is therefore an object of the invention to provide a method and device for depositing sliver in a rotating can which overcomes the aforementioned disadvantages of the heretofore known devices of this general type and to prevent or at least reduce such long-wave density variations of the finished yarn after the sliver deposited in the cans is processed.

With the foregoing and other objects in view there is provided, in accordance with the invention, a method for depositing sliver formed of textile fibers in cycloidal loops in a rotating can, which comprises feeding the sliver through a rotating funnel wheel having a guide canal formed therein with an opening extending toward the can, and rotating the funnel wheel with periodically changing angular velocity to reduce variation in sliver deposit velocity. The funnel wheel is now rotated at a periodically changing angular velocity, and specifically, in such a manner that the extent of the variation of the component of the relative velocity between the funnel wheel and the can pointing in the sliver deposition direction, as measured at the canal opening, becomes smaller. At this point, the maximum angular velocity which must be provided depends on whether the funnel wheel and the can turntable rotate in the same direction or not. Rotation of both parts in the same direction is the normal case.

In accordance with another mode of the invention, there is provided a method which includes rotating a turntable on which the can is disposed with periodically changing angular velocity to reduce variation in sliver deposit velocity.

In accordance with a further mode of the invention, there is provided a method which includes rotating the funnel wheel at an angular velocity greater than the mean angular velocity when the canal opening is located in the vicinity of the wall of the can, and less than the mean angular velocity when the canal opening is located in the vicinity of the axis of the can.

In accordance with an added mode of the invention, there is provided a method which includes rotating the turntable at an angular velocity greater than the mean angular velocity when the canal opening is located in the vicinity of the wall of the can, and less than the mean angular velocity when the canal opening is located in the vicinity of the axis of the can.

Rather good results are, in fact, obtained if the angular velocity is changed periodically with a small amplitude only.

If the sliver is deposited in so-called large loops which always lead around the central axis of the can, it is entirely sufficient to rotate the funnel wheel alone with periodically changing angular velocity. If the sliver is deposited in so-called small loops, which never include the central axis of the can, it is more advantageous, on the other hand, to also rotate the can turntable besides the funnel wheel, in phase with periodically changing angular velocity. In all cases, a more constant sliver deposition velocity is obtained if the can turntable is rotated with periodically changing angular velocity as well.

In an effort to keep the sliver deposition velocity in the direction of the cycloid curve as constant as possible, and in accordance with an additional mode of the invention, there is provided a method which includes controlling the angular velocity of the funnel wheel with a supplemental transmission to obtain a substantially constant sliver deposit velocity.

In accordance with yet another mode of the invention, there is provided a method which includes controlling the angular velocity of the turntable with a supplemental transmission to obtain a substantially constant sliver deposit velocity.

In accordance with yet a further mode of the invention, there is provided a method wherein the supplemental transmission controls the angular velocity according to the formula:

$$\alpha(t)=\hat{\alpha}(0)+2\cdot Re\hat{\alpha}(1)\cdot\cos\left[\hat{\alpha}(0)\cdot t\right]$$

where $\alpha(t)$ is the angular velocity;

$\hat{\alpha}(0)$ is the Fourier coefficient of the angular velocity; and $Re\hat{\alpha}(1)$ is the real part of the Fourier coefficient of the first harmonic of the angular velocity:

Further in accordance with the invention, there is provided a device for carrying out the method for depositing sliver formed of textile fibers in cycloidal loops in a rotating can comprising a rotatable funnel wheel disposed above the can, the funnel wheel having a sliver feed guide canal formed therein with an opening extending toward the can, the can being disposed on a rotatable turntable, an output shaft for rotating the funnel wheel, and a supplemental transmission connected to the output shaft for periodically changing the angular velocity thereof.

In accordance with another feature of the invention, there is provided an additional output shaft for rotating the turntable, the supplemental transmission being connected to the additional output shaft.

In accordance with a further feature of the invention, the supplemental transmission includes a periodically changing drive followed in drive relationship by a summing transmission.

In accordance with a concomitant feature of the invention, the summing transmission is a revolving gear transmission and the periodically changing drive includes a crank mechanism with equal legs, a transverse crank, a cam gear, a reciprocating centered crank loop, a plane non-offset crank mechanism or a centered non-offset sliding block crank.

Periodically reducing transmissions in the form of a crank mechanism with equal legs, a transverse crank or a cam gear are capable of exactly furnishing the angular velocity in accordance with the formula $\tilde{\alpha}(t)=2\cdot Re\hat{\alpha}(1)\cdot\cos[\hat{\alpha}(0)\cdot t]$. This motion rule is approximately fulfilled by the following periodically changing transmissions:

A reciprocating centered crank slot or loop; plane, not offset crank mechanism; and centered or not offset sliding block crank.

As summing transmissions, four-member, five-member or six-member revolving-gear transmissions can be chosen. Four-member revolving gear transmissions can be coupled to each other with a common bridge. If the two revolving gears are combined in a revolving dual gear, five-member revolving gear transmissions are generated, into which two angular driving velocities are fed and an angular output velocity is obtained (three-shaft drive).

The advantages obtained with the invention are in particular that the extent of the variation of the sliver deposition velocity can be reduced in a simple manner to such an extent that the harmful consequences of nonuniform sliver deposition in the further processing no longer occur.

Other features which are considered as characteristic for the invention are set forth in the appended claims.

Although the invention is illustrated and described herein as embodied in method and device for depositing sliver in a rotating can, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
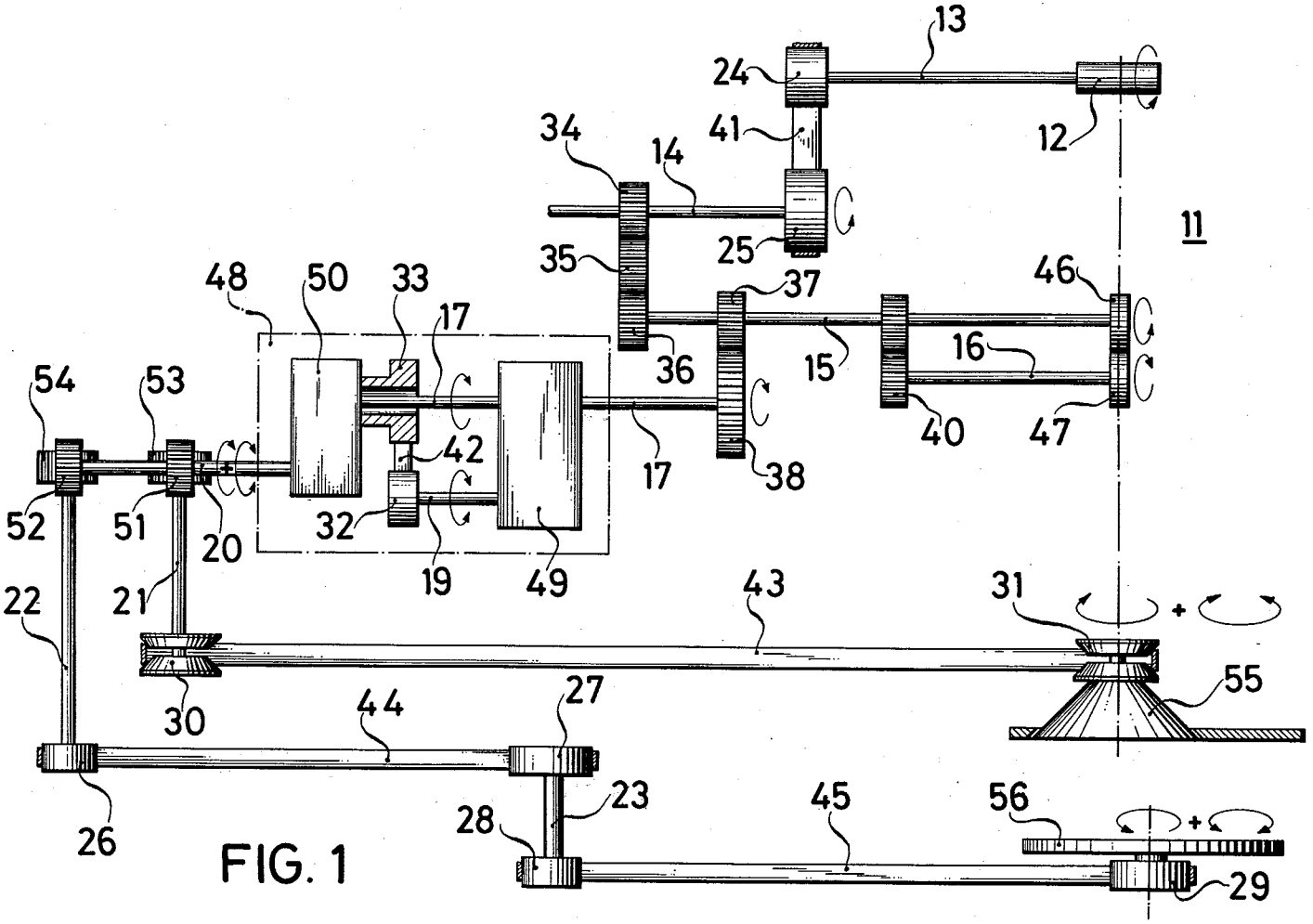
FIG. 1 is a schematic diagram of the gearing in accordance with the invention.

Referring now to the figures of the drawing and first, particularly to FIG. 1 thereof, there is seen a gearing schematic showing a section indicated as a whole by reference numeral 11 and a supply stretching mechanism 12 which is driven by a shaft 13. On the shaft 13 is mounted a pulley 24, which is connected to a pulley 25 by a belt 41. The pulley 25 is mounted on a shaft 14 which serves to drive the section 11. Through gears 34, 35, 36 the shaft 14 drives a shaft 15, on which a calender roll 46 is fastened. The same shaft 15 drives a further calender roll 47 through a gear 40 and a shaft 16.

In FIG. 1 is further seen a supplemental transmission indicated as a whole by reference numeral 48. The supplemental transmission 48 includes a periodically reducing transmission 49 and a summing transmission 50. The drive shaft 17 of the periodically reducing or changing transmission 49 is driven by the shaft 15 through gears 37, 38. On the output shaft 20 of the summing transmission 50 are mounted two gears 51, 52. The gear 51 drives a gear 53 and the gear 52 drives a gear 54. The gear 53 in turn drives a pulley 30 through a shaft 22.

A funnel wheel 55 is driven by a belt 43 by means of a pulley 31; the belt 43 is looped around the pulley 30. Below the funnel wheel 55 is seen a can turntable 56, which is driven by means of a pulley 29 by a belt 45 which is looped around the pulley 28. The latter is part of a transmission which also includes a shaft 23 and a pulley 27. The pulley 27 is connected to the pulley 26 on the shaft 22 through the belt 44.

It is seen in FIG. 1 that the axis of rotation of the can turntable 56 is offset from the axis of rotation of the funnel wheel 55.

Without the supplemental drive or transmission 48, there would be a direct connection between the shaft 17 and the shaft 20, so that the funnel wheel 55 and, at a lower speed, the can turntable 56 as well, would rotate with constant angular velocity. The supplemental drive 48 now assures that the funnel wheel and the can turntable are rotated with periodically changing angular velocity. Details of this drive system will be seen from the embodiment example for the supplemental drive according to FIG. 2.

Figure 2:
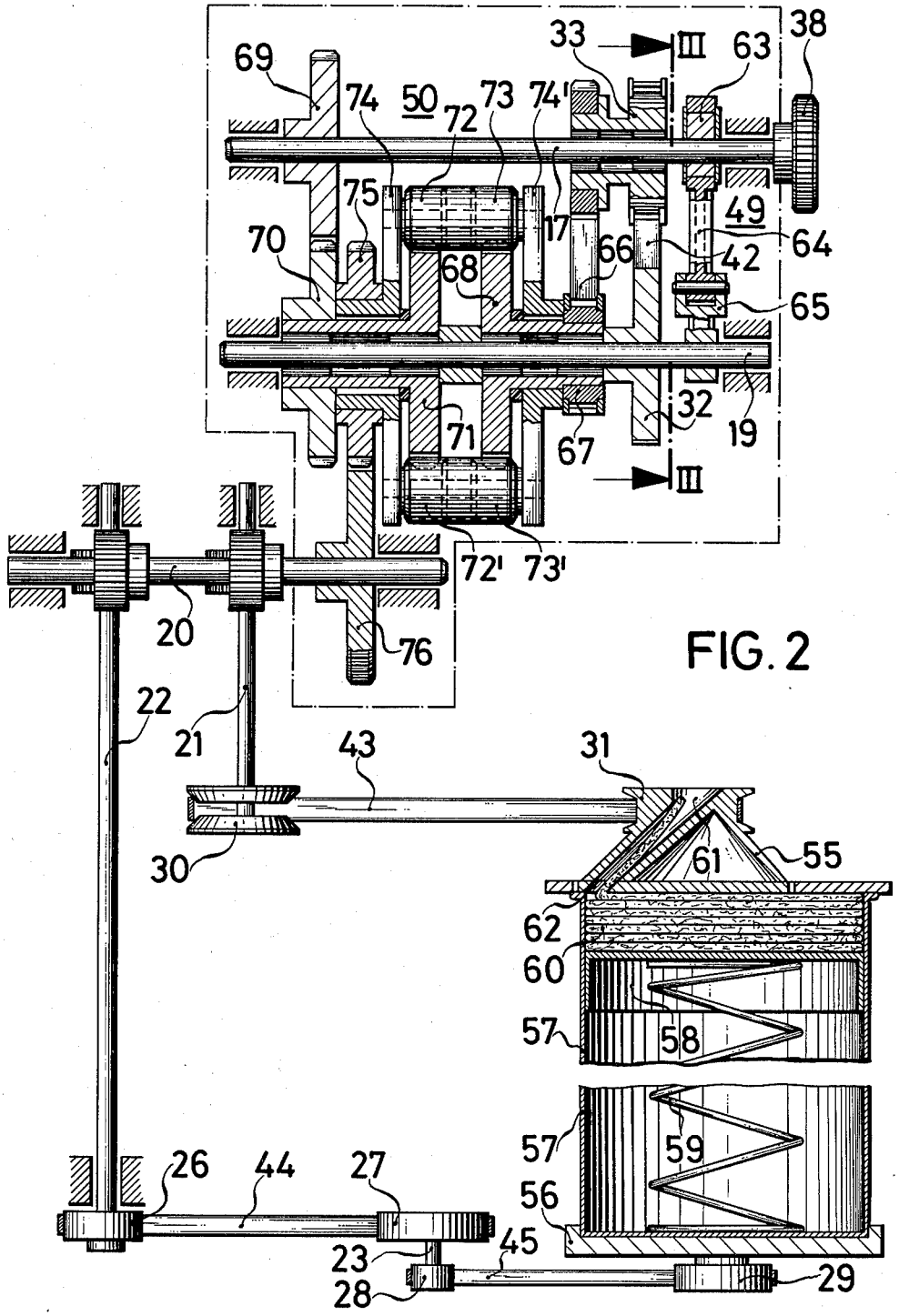
FIG. 2 is a diagrammatic front elevational view of a supplemental transmission according to the invention.

It is seen in FIG. 2 that a can 57 stands on the can turntable 56; the upper edge of the can 57 extends to below the funnel wheel 55. The can 57 has a movable spring bottom 58, against which a can spring 59 pushes from below. On the spring bottom 58, previously deposited sliver is seen.

The funnel wheel 55 has a sliver guide canal 61, the canal opening of which points toward the can.

Figure 3:
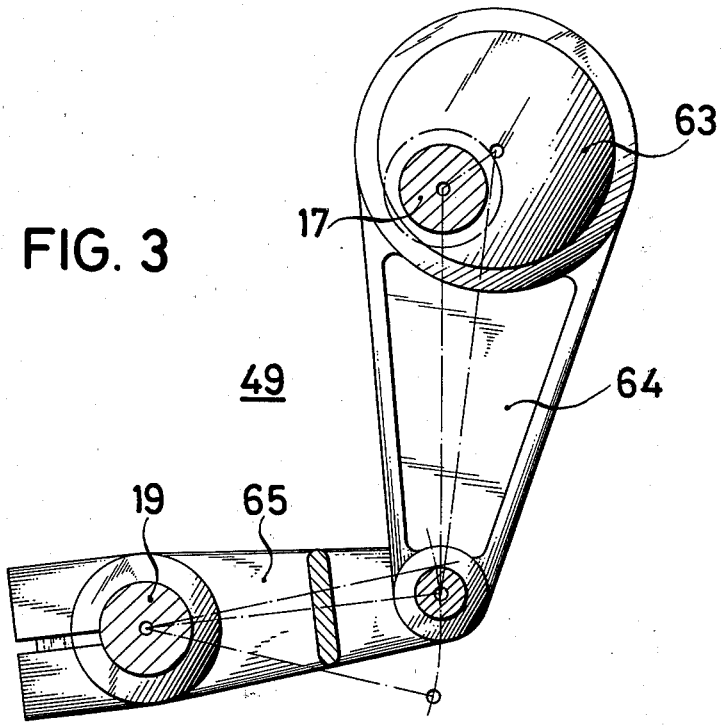
FIG. 3 is a side elevational view of the centered or non-offset crank drive taken along the line III—III in FIG. 2 in the direction of the arrows.

The periodically changing or transmitting drive, which is designated as a whole by reference numeral 49 in FIG. 2 and is shown in detail in FIG. 3, includes a centered or non-offset crank drive. The crank drive includes a crank 63 fastened on the shaft 17 with a link 64 which is hinged to a rocker arm 65. The rocker arm 65 is connected to the shaft 19.

The rotary motion initiated through the gear 38 is transmitted to the crank 63 and through the link 64 to the rocker arm 65. The rocker arm 65 moves the shaft 19 and thereby the toothed or serrated pulley 32 fastened to the shaft 19. Through the toothed or serrated belt 42, the dual toothed or serrated pulley 33 is driven. A toothed or serrated belt 66 and a toothed or serrated pulley 67, which is rotatably mounted on the shaft 19 are driven by the serrated pulley 33. The serrated pulley 67 is connected to a sun gear 68. The serrated pulley 67 and the sun gear 68 are part of the summing transmission, which is designated as a whole with reference numeral 50.

The toothed or serrated-belt transmission stage serves to adapt the amplitude of the oscillation of the crank drive to the required amplitude 2Re(1) from the following formula:

$$\alpha(t)=\hat{\alpha}(0)+2\cdot Re\,\hat{\alpha}(1)\cdot\cos[\hat{\alpha}(0)\cdot t]$$

Where $\alpha(t)$ is the angular velocity;

$\hat{\alpha}(0)$ is the Fourier coefficient of the angular velocity; and $Re\hat{\alpha}(1)$ is the real part of the Fourier coefficient of the first harmonic of the angular velocity.

If the crank drive is optimally constructed, the toothed or serrated-belt transmission stage can be omitted all together. In that case, the swinging motion is then transmitted directly to the sun gear 68.

The angular velocity corresponding to the constant factor $\hat{\alpha}(0)$ from the hereinaforementioned formula for the angular velocity is transmitted through the shaft 17, which is firmly connected to the gear 38 and through a pair of gears 69, 70, to a sun gear 71, which is connected to the gear 70 and is mounted rotatably on the shaft 19. Through the meshing revolving gears 72, 73 and 72', 73', respectively, the sum of the movements is transmitted according to the relation $\omega_{74}=\lambda(\omega_{68}+\omega_{71})$ to the two-part bridge 74, 74' and thereby, through a pair of gears 75, 76, to the output shaft 20; in the case shown, $\lambda=\frac{1}{2}$. The motion is passed-on to the funnel wheel 55 through the shaft 21 and to the can turntable 56 through the shaft 22.

Due to the symmetrical disposition of the revolving gears 72, 73 and 72', 73', respectively, an advantageous transmission of the motion and also good mass balance are obtained.

The invention is not limited to the embodiment example shown and described. Four-member, five-member and six-member revolving-gear transmissions are generally suited for the summing transmission, as already mentioned. The periodically changing or reducing drive or transmission 49 may comprise a crank mechanism with equal legs, a transverse crank, a cam gear, a reciprocating centered crank loop or slot, a plane non-offset crank mechanism or a centered or non-offset sliding-block crank.

There are claimed:

1. Method for depositing sliver formed of textile fibers in cycloidal loops in a rotating can, which comprises feeding the sliver through a rotating funnel wheel having a guide canal formed therein with an opening extending toward the can, and rotating the funnel wheel with periodically changing angular velocity to reduce variation in sliver deposit velocity.

2. Method according to claim 1, which includes rotating a turntable on which the can is disposed with periodically changing angular velocity to reduce variation in sliver deposit velocity.

3. Method according to claim 1 or 2 which includes rotating the funnel wheel at an angular velocity greater than the mean angular velocity when the canal opening is located in the vicinity of the wall of the can, and less than the mean angular velocity when the canal opening is located in the vicinity of the axis of the can.

4. Method according to claim 3, which includes rotating the turntable at an angular velocity greater than the mean angular velocity when the canal opening is located in the vicinity of the wall of the can, and less than the mean angular velocity when the canal opening is located in the vicinity of the axis of the can.

5. Method according to claim 4, which includes controlling the angular velocity of the funnel wheel with a supplemental transmission to obtain a substantially constant sliver deposit velocity.

6. Method according to claim 5, which includes controlling the angular velocity of the turntable with a supplemental transmission to obtain a substantially constant sliver deposit velocity.

7. Method according to claim 6, wherein the supplemental transmission controls the angular velocity according to the formula:

$$\alpha(t)=\hat{\alpha}(0)+2\cdot Re\hat{\alpha}(1)\cdot\cos\,[\hat{\alpha}(0)\cdot t]$$

where $\alpha(t)$ is the angular velocity;

$\hat{\alpha}(0)$ is the Fourier coefficient of the angular velocity; and $Re\hat{\alpha}(1)$ is the real part of the Fourier coefficient of the first harmonic of the angular velocity.

8. Device for carrying out the method for depositing sliver formed of textile fibers in cycloidal loops in a rotating can, comprising a rotatable funnel wheel disposed above the can, said funnel wheel having a sliver feed guide canal formed therein with an opening extending toward the can, the can being disposed on a rotatable turntable, output shaft means for rotating said funnel wheel, and supplemental transmission means connected to said output shaft means for periodically changing the angular velocity thereof.

9. Device according to claim 8, including additional output shaft means for rotating said turntable, said supplemental transmission means being connected to said additional output shaft means.

10. Device according to claim 8 or 9, wherein said supplemental transmission means includes a periodically changing drive followed in drive relationship by a summing transmission.

11. Device according to claim 10, wherein said summing transmission is a revolving gear transmission and said periodically changing drive includes a crank mechanism with equal legs, a transverse crank, a cam gear and at least one of a reciprocating centered crank loop, a plane non-offset crank mechanism and a centered non-offset sliding block crank.

* * * * *